United States Patent [19]

Albrecht et al.

[11] Patent Number: 4,536,193

[45] Date of Patent: Aug. 20, 1985

[54] STIRRER OF A REACTOR FOR GASIFYING SOLID FUELS

[75] Inventors: Johannes Albrecht, Frankfurt am Main; Rudolf Jakobs, Bad Homburg; Osman Turna, Frankfurt am Main; Helmut Vierrath, Neu-Isenburg; Manfred Weil, Rockenberg; Klaus Zapke, Maintal, all of Fed. Rep. of Germany

[73] Assignee: Metallgesellschaft Aktiengesellschaft, Frankfurt am Main, Fed. Rep. of Germany

[21] Appl. No.: 536,147

[22] Filed: Sep. 27, 1983

[30] Foreign Application Priority Data

Oct. 23, 1982 [DE] Fed. Rep. of Germany ..... 3239320

[51] Int. Cl.[3] ..... C10J 3/30; C10J 3/32

[52] U.S. Cl. ..... 48/77; 48/85.2; 241/300; 366/343; 416/224

[58] Field of Search ..... 48/85.2, 87, 77, 63, 48/86 A; 241/300, 282.1; 366/349, 343; 416/224, 96; 415/121 B; 110/258, 247; 422/225; 432/139

[56] References Cited

U.S. PATENT DOCUMENTS

| | | | |
|---|---|---|---|
| 2,440,940 | 5/1948 | Galusha | 48/85.2 |
| 3,430,898 | 3/1969 | Parechanian et al. | 416/224 |
| 3,951,616 | 4/1976 | Rudolph | 48/85.2 |
| 4,315,757 | 2/1982 | Woodmansee | 48/85.2 |

*Primary Examiner*—Jay H. Woo
*Assistant Examiner*—Joye Woodard
*Attorney, Agent, or Firm*—Sprung Horn Kramer & Woods

[57] ABSTRACT

A reactor for gasifying solid fuels, particularly coal, comprises with the fixed bed of fuel at least one stirring arm, which is rotatable about a vertical axis and is approximately triangular in cross-section. The forward knife edge and the rear crushing edge of the stirring arm are provided with replaceable armoring. The armoring at the knife edge consists of a plurality of armoring elements (7), which are approximately V-shaped in cross-section and are arranged one beside the other so as to define an expansion joint. The armoring at the crushing edge consists also of a plurality of elements (10), which are mounted on the stirring arm so as to be movable at ambient temperature.

7 Claims, 3 Drawing Figures

STIRRER OF A REACTOR FOR GASIFYING SOLID FUELS

BACKGROUND OF INVENTION

1. Field of Invention

This invention relates to a reactor for gasifying granular fuels, particularly coal, under a pressure of 5 to 150 bars by a treatment with gasifying agents which contain free oxygen, steam and/or carbon dioxide, wherein the fuel forms in the reactor a fixed bed, which is gradually descending, the gasifying agents are introduced into the fixed bed from below, the incombustible mineral constituents of the fuel are withdrawn below the fixed bed as solid ash or liquid slag, and the fixed bed contains at least one stirring arm, which is rotatable about a vertical axis and is approximately triangular in cross-section and has a knife edge penetrating through the coal bed and a rear crushing edge.

2. Discussion of Prior Art

Such a stirrer is known from German Pat. No. 23 53 241 and from the corresponding U.S. Pat. No. 3,951,616. German Patent Publication No. 10 21 116 also shows a reactor having a stirring arm. The gasification of solid fuels is known and disclosed, e.g., in Ullmanns Encyklopadie der technischen Chemie, 4th edition (1977), Volume 14, on pages 383 to 386. Details of the gasification involving a formation of solid ash are apparent from U.S. Pat. Nos. 3,540,867 and 3,854,895. The modification of the process involving a formation of liquid slag has been explained in British Patent Specifications Nos. 1,507,905; 1,508,771 and 1,512,677.

The fuel which is suitable for the reactor usually consists of non-caking, swellable or caking coal although other carbonaceous materials, such as wood, peat or biomass can also be gasified. The granular fuel has a particle size in the range of about 3 to 60 mm so that the fixed bed is adequately permeable to gas. It is known to loosen the fixed bed by means of a stirrer having one or more stirring arms in order to improve the permeability to gas.

SUMMARY OF INVENTION

It is an object of the invention to provide a stirring arm which can be used in the temperature range of 200° to 1100° C. and which is suitable even for heavy loads. This is accomplished in accordance with the invention in that the knife edge and the crushing edge of the stirring arm are provided with replaceable armoring and the armoring at the knife edge consists of a plurality of armoring elements, which are approximately V-shaped in cross-section and arranged one beside the other so as to define an expansion joint. Because the armoring is replaceable, a higher wear can be tolerated and for the same purpose the crushing edge may also be armored by means of a plurality of individual elements, which are individually replaceable.

A further advantage afforded by the armoring elements at the knife edge resides in that differential thermal expansion does not give rise to stresses in the armoring.

According to preferred further feature of the invention, the armoring elements are mounted on the stirring arm so as to be movable at ambient temperature. This applies to the armoring at the knife edge and to the composite armoring at the crushing edge. With that design, stresses between the stirring arm, which is usually water-cooled, and the armoring in contact with the hot coal are avoided.

BRIEF DESCRIPTION OF DRAWINGS

An embodiment of the stirring arm is diagrammatically shown on the drawing, in which.

DESCRIPTION OF SPECIFIC EMBODIMENT

Figure 3:
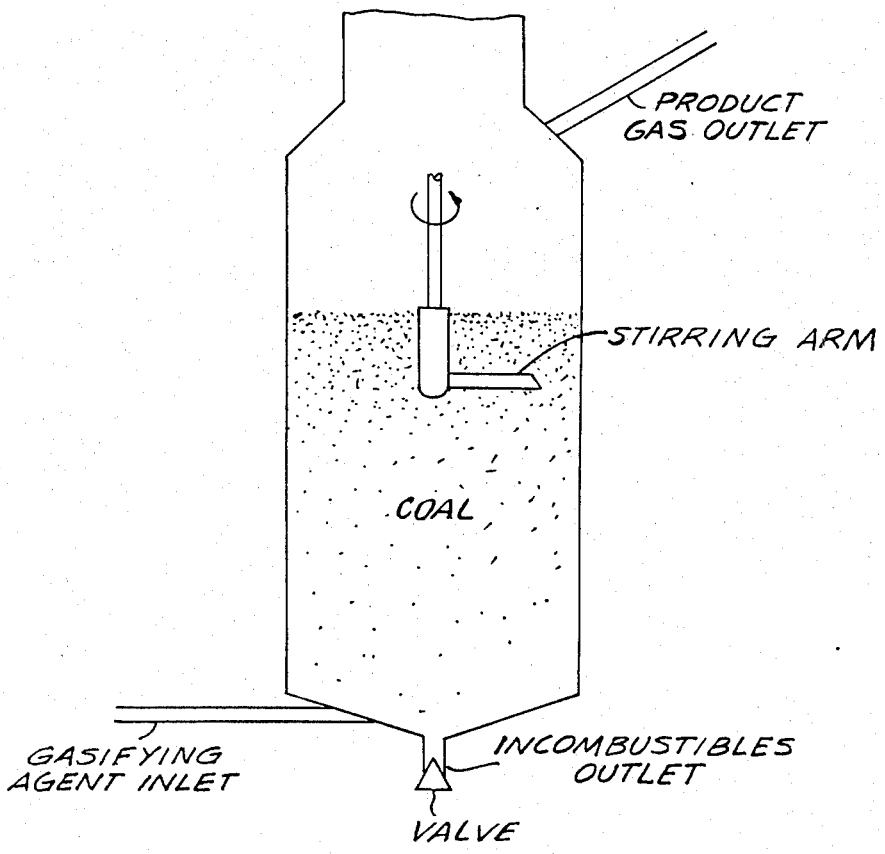
Fig. 3 PRIOR ART
FIG. 3 is a longitudinal sectional view of a typical reactor for gasifying granular fuels, particularly coal.

Referring to FIG. 3, there is shown a gasifying reactor for gasifying a fixed bed of coal. A gasifying agent enters from below via a gasifying agent inlet and passes through the fixed bed of coal containing the stirring arm of the invention. Product gas leaves via a product gas outlet and incombustibles are removed via an incombustibles outlet fitted with a valve.

Figure 1:
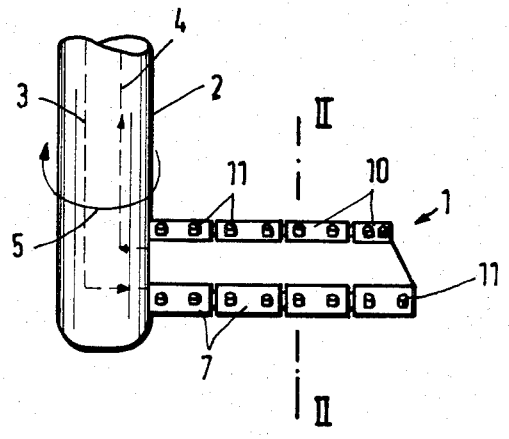
FIG. 1 is an elevation showing a stirring arm.

The stirring arm 1 shown in FIG. 1 is secured to a vertical rotary shaft 2, which contains cooling water passages 3 and 4, which are indicated by dotted lines.

Figure 2:
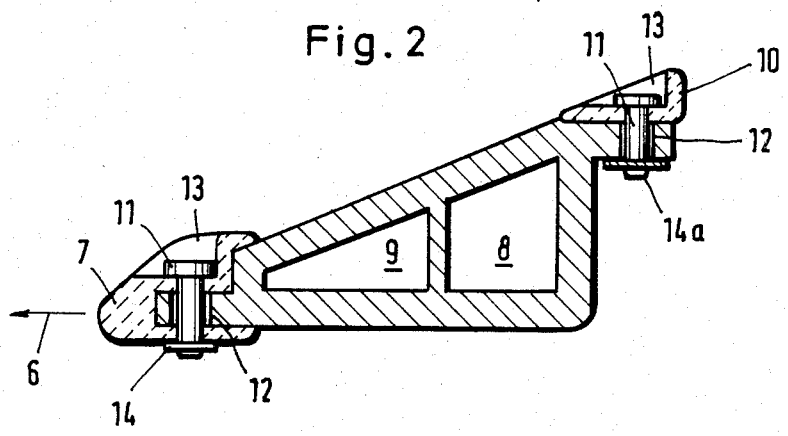
FIG. 2 is an enlarged sectional view taken on line II—II in FIG. 1.

The shaft 2 and the stirring arm 1 are cooled by the cooling water. During operation the stirring arm 1 is moving through the fixed bed of the granular fuel, which is to be gasified. When the shaft 2 is moving in the sense of rotation 5 (FIG. 1), the stirring arm, which is approximately triangular in cross-section (see FIG. 2) moves through the fixed bed of fuel in the direction of the arrow 6.

To protect the forward edge of the stirring arm, which forward edge may be described as a knife edge, the stirring arm is provided with a number of armoring elements 7, which are approximately V-shaped in cross-section. The stirring arm has two chambers 8 and 9 for conducting cooling water in mutual by opposite directions. The top rear edge of the stirring arm is described as a crushing edge and is also armored and for this purpose is provided with wedge-shaped armoring plates 10. In a direction which is parallel to the radial extent of the stirring arm, the armoring elements 7 and the plates 10 have a width of about 5 to 50 cm, and an expansion joint is defined between adjacent elements 7 or plates 10 and may have a width of 0.1 to 5 mm at ambient temperature.

The elements 7 and plates 10 are so secured to the water-cooled stirring arm that the armoring is still movable to a slight extent relative to the stirring arm so that the high temperature differences do not result in stresses and damage. The fixing means shown in FIG. 2 consist of bolts 11 having shank diameters which are smaller than the associated bore 12 of the stirring arm. Differences in diameter of 1 to 3 mm will usually be sufficient. The head of the bolt 11 is accommodated in a recess 13 formed in the armoring element 7 or the plate 10 and does not protrude from the contour of the element 7 or the plate 10. Each bolt at the knife edge is locked by a retaining ring 14. The retaining plate **14*a* provided at the crushing edge consists of a rectangular split head shield. The material of the armoring elements 7 and of the plates 10** must resist wear at temperatures up to 1100° C. and for this reason may consist e.g. of various kinds of nickel-chromium steel or of ceramics.

What is claimed is:

1. In a reactor for gasifying granular fuels, particularly coal, under a pressure of 5 to 150 bars by a treatment with gasifying agents which contain free oxygen, steam and/or carbon dioxide, wherein the fuel forms in the reactor a descendable fixed bed, means for introducing the gasifying agents into the fixed bed from below, means for withdrawing the incombustible mineral constituents of the fuel below the fixed bed as solid ash or liquid slag, and at least one stirring arm in the fixed bed which is rotatable about a vertical axis and is approximately triangular in cross-section and has a knife edge penetrating through the fixed bed and a rear crushing edge, which is the top rear edge, the improvement wherein each of the knife edge and the crushing edge of the stirring arm is provided with a replaceable armoring, the armoring at the knife edge comprises a plurality of armoring elements, which are substantially V-shaped in cross-section and arranged one beside the other so as to define an expansion joint, and the armoring at the crushing edge comprises a plurality of wedge-shaped armoring plates arranged one beside the other, said armoring elements and said armoring plates being mounted on the stirring arm so as to be movable at ambient temperature and said armoring elements and said armoring plates having a width of 5 to 50 cm measured in the direction which is parallel to the radial extent of the arm.

2. A reactor according to claim 1, wherein the armoring elements at the knife edge and at the crushing edge are mounted on the stirring arm by bolts.

3. A reactor according to claim 2, wherein said bolts pass through bores on said stirring arm with clearance, whereby imposition of high temperatures does not result in damage to said stirring arm.

4. A reactor according to claim 3, wherein said clearance is 1 to 3 mm.

5. A reactor according to claim 1, wherein said expansion joint has a width of 0.1 to 5 mm, measured at ambient (room) temperature.

6. A reactor according to claim 1, wherein said stirring arm is provided with a plurality of chambers and said reactor comprises means for passing a cooling fluid through said chambers.

7. A reactor according to claim 1, wherein there are two chambers and the apparatus comprises means for feeding the cooling fluid in opposite directions through said chambers.

* * * * *